US006247415B1

(12) United States Patent
Appeltans et al.

(10) Patent No.: US 6,247,415 B1
(45) Date of Patent: Jun. 19, 2001

(54) DEVICE FOR PROTECTING SECURITIES

(75) Inventors: Guy Appeltans, Houthalen; Luc Mellebeek, Opglabbeek, both of (BE)

(73) Assignee: FN Hertsal, S.A., Herstal (BE)

( * ) Notice: Subject to any disclaimer, the term of this patent is extended or adjusted under 35 U.S.C. 154(b) by 0 days.

(21) Appl. No.: 09/739,203

(22) Filed: Dec. 19, 2000

Related U.S. Application Data

(62) Division of application No. 09/147,728, filed as application No. PCT/BE97/00095 on Aug. 26, 1997, now Pat. No. 6,178,897.

(30) Foreign Application Priority Data

Sep. 2, 1996 (BE) ..... 9600737

(51) Int. Cl.[7] ..... E05G 1/14; G08B 15/02

(52) U.S. Cl. ..... 109/33; 109/36; 109/37; 109/41; 109/45

(58) Field of Search ..... 109/33, 35–37, 109/34, 39, 41, 44, 45

(56) References Cited

U.S. PATENT DOCUMENTS

| | | | |
|---|---|---|---|
| 1,266,353 | 5/1918 | Trantham | 109/33 |
| 1,606,516 | 11/1926 | Daly . | |
| 2,035,498 | 3/1936 | Navis et al. . | |
| 3,489,107 | 1/1970 | Uhrig et al. | 109/36 |
| 3,650,226 | 3/1972 | Conroy et al. | 109/25 |
| 3,732,830 | 5/1973 | Lindstedt, Jr. | 109/36 |
| 4,236,463 | 12/1980 | Westcott | 109/33 |

FOREIGN PATENT DOCUMENTS

| | | | |
|---|---|---|---|
| 1584277 | 1/1970 | (DE) . | |
| 2355820 | 5/1975 | (DE) . | |
| 669772 | 11/1929 | (FR) | 109/44 |
| 2595491 | 9/1987 | (FR) . | |
| 1138104 | 12/1968 | (GB) . | |
| WO83/02975 | 9/1983 | (WO) . | |
| WO90/09504 | 8/1990 | (WO) . | |
| WO91/17681 | 11/1991 | (WO) | 109/36 |

*Primary Examiner*—Lloyd A. Gall
(74) *Attorney, Agent, or Firm*—Bacon & Thomas, PLLC

(57) ABSTRACT

The invention concerns a protective device for valuable documents, including a volume capable of being closed and divided into two compartments, one of the compartments being used to receive the documents to be protected while in the second compartment caps contain a pyrotechnic mixture which, when the device is wrongly manipulated, will burst into a flame and penetrate the documents in the first mentioned compartment.

8 Claims, 6 Drawing Sheets

Fig.1
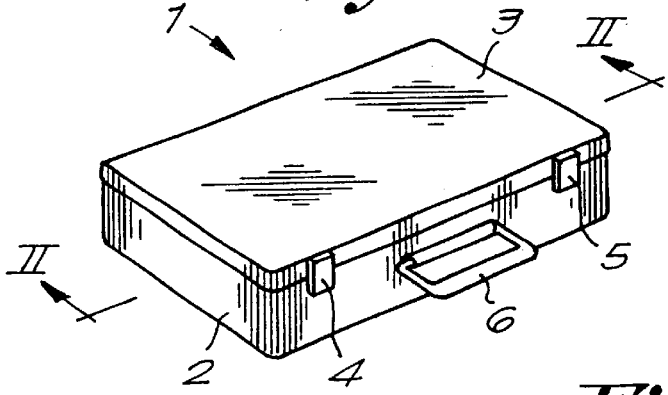
Fig.2
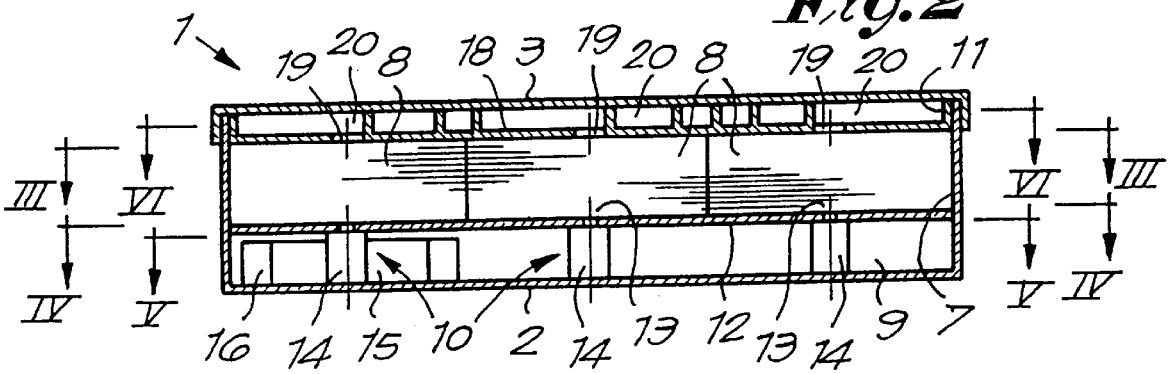
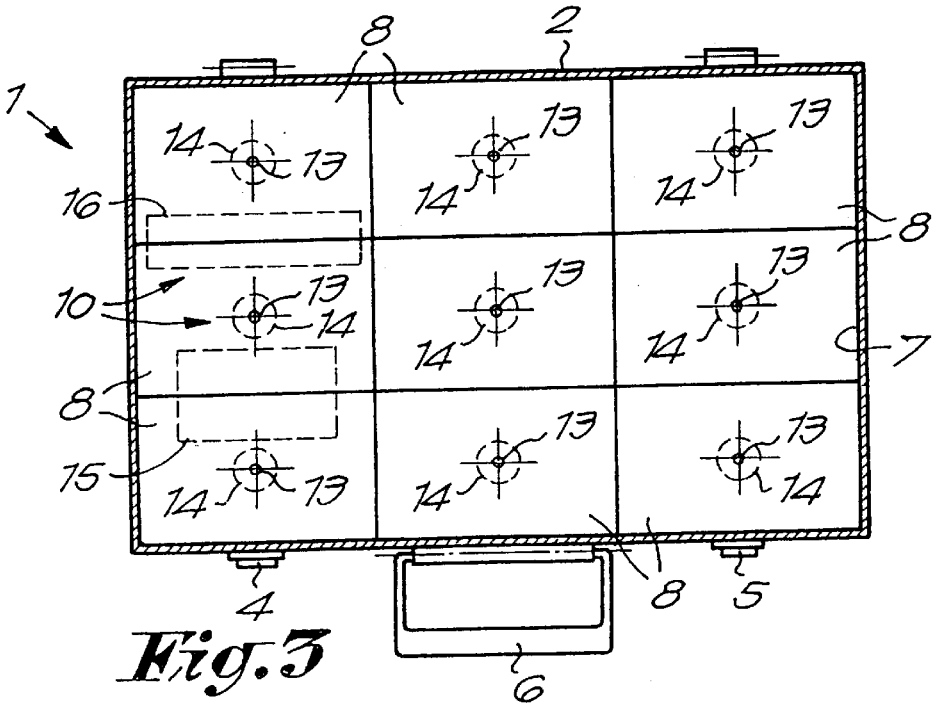
Fig.3

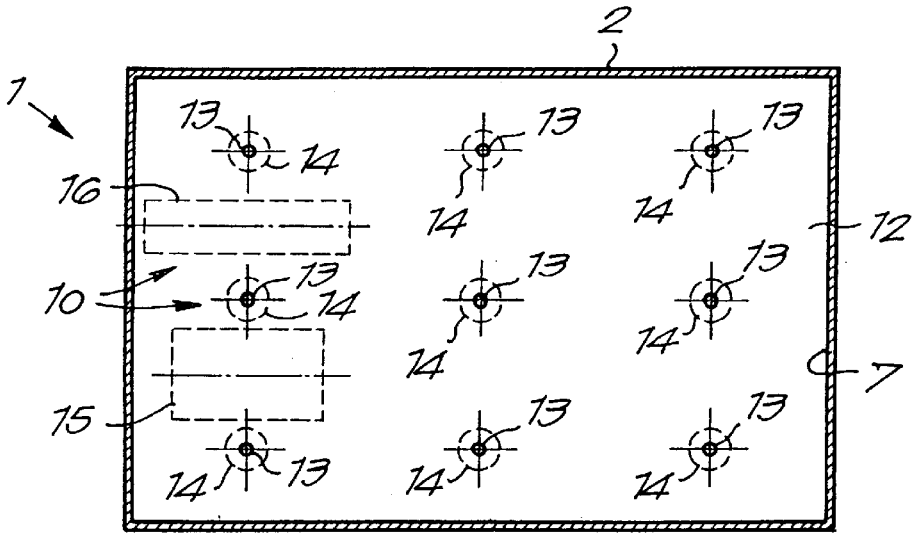
Fig.4
Fig.5
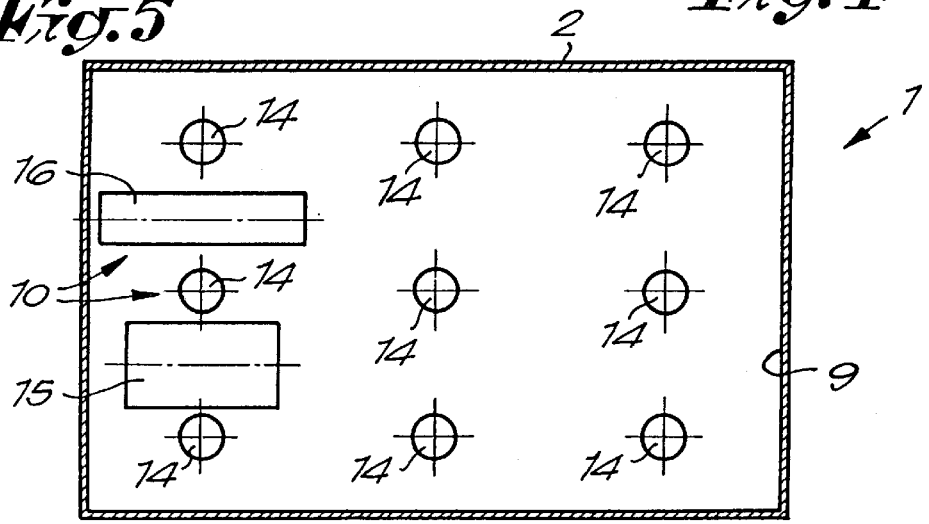
Fig.6
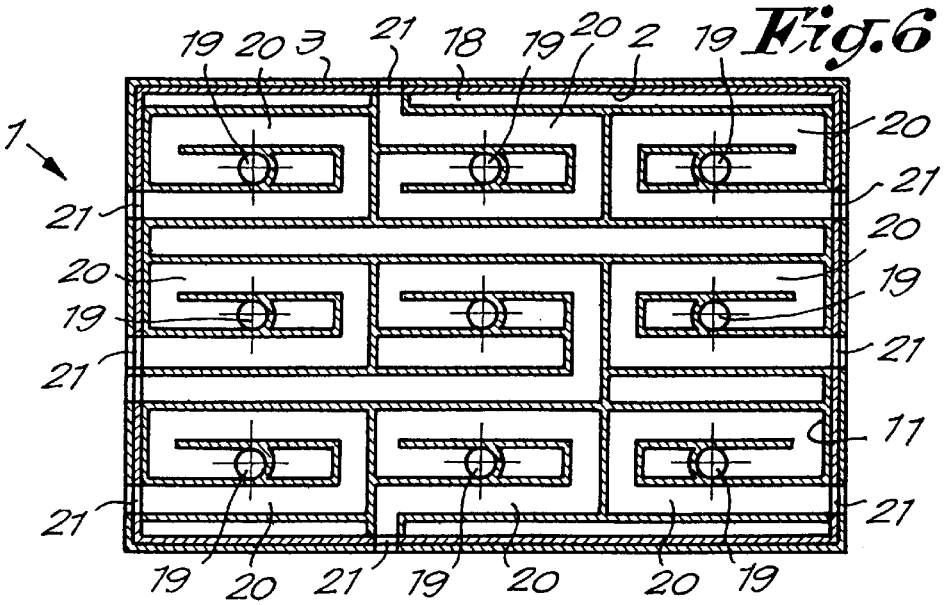

| Pyrotechnical charge | Combustible | Inflammation agent (oxidant) | Bonding material | Lubricant |
|---|---|---|---|---|
| Ignition charge | 20-30%<br>- magnesium<br>- aluminium | 60-80%<br>- barium peroxide<br>- barium nitrate<br>- strontium peroxide<br>- strontium nitrate | 5 - 10%<br>- synthetic phenol resin<br>- gum lac<br>- acacia gum | 1-3%<br>- graphite<br>- zinc stearate |
| Fire destruction charge | 15-35%<br>- magnesium<br>- aluminium<br>- Mg/Al 50/50 | 50-80%<br>- barium nitrate<br>- potassium perchlorate<br>- iron oxide | 5-10%<br>- synthetic phenol resin<br>- gum lac<br>- acacia gum | 1-3%<br>- graphite<br>- zinc stearate |

Fig. 10

DEVICE FOR PROTECTING SECURITIES

This application is a Division of nonprovisional application Ser. No. 09/147,728 filed Feb. 25, 1999, U.S. Pat. No. 6,178,897 which is a 371 of PCT/BE97/00095, filed Aug. 26, 1997.

BACKGROUND OF THE INVENTION

1. Field of the Invention

The present invention concerns a device for protecting securities such as shares, bonds, bank notes and the like whereby this device consists of a unit which can be closed, and which is divided in at least two spaces, whereby the first space is designed to hold the papers to be protected, whereas pyrotechnical means are provided in the second space which, when the device is manipulated in an unwanted manner, make the above-mentioned papers worthless.

In particular, the present invention concerns a device of the type which is mounted in a fixed or portable manner in a private or public building, in a bank, in a means of transport or the like.

2. Brief Description of the Related Art

Devices of this type are already known which, when they are used in the wrong manner, for example in case of a burglary, or when the latter or similar devices are opened in an unwanted manner, the content is exposed to ink, smoke or another material so as to damage or destroy the securities.

However, it was found that when the papers provided in these known devices so as to protect them are not always entirely damaged and/or destroyed after somebody has attempted to open the device in an unwanted manner or after somebody has entered the wrong code in case of combination locks or such.

It was found that in those cases, a relatively large number of securities remains nevertheless undamaged, such that it is still worth while to force these devices.

Another type of device for protecting securities is known from U.S. Pat. No. 4,236,463. This known device consists of a case which is divided in at least two spaces, whereby the first space can hold the papers to be protected, whereas the second space is entirely filled with a non-explosive thermite load which closes off the first space and which, when the device is manipulated in an unwanted manner, will become overheated up to over 1649° C. as a result of a chemical reaction, as a result of which the papers contained in the first space will carbonize.

SUMMARY OF THE INVENTION

The present invention aims a device for protecting securities, in particular a device which makes these papers completely useless when the device is opened in an unwanted manner or when the device is manipulated by someone who does not know the code, but in such a manner that data provided on these papers, such as identification numbers or such remain intact.

To this aim, according to the present invention, the pyrotechnical means which are situated in the second space are capsules which each contain a pyrotechnical mixture which, when the device is manipulated in an unwanted manner as mentioned above, will inflame so as to produce a flame which transpierces the papers contained in the first space.

According to a preferred embodiment, the device according to the present invention will be equipped with at least one maze or labyrinth through which the produced gases can escape, such that flames nor gases under pressure can in no way whatsoever escape from the device when the security system is activated.

In a similar manner, retardation mechanisms can be provided on the means causing the destruction of the securities, such that the latter are destroyed at short intervals, so as to avoid that the destruction is too brutal at a given moment and that flames and/or gases under pressure escape from the device.

BRIEF DESCRIPTION OF THE DRAWINGS

In order to better explain the characteristics of the invention, the following two devices according to the invention are described as an example only without being limitative in any way, with reference to the accompanying drawings, in which:

FIG. 1 shows a view in perspective of a device according to the invention, made in this case in the shape of a portable briefcase;

FIG. 2 shows a section according to line II—II in FIG. 1 to a larger scale;

FIGS. 3, 4, 5 and 6 respectively show sections according to lines III—III, IV—IV, V—V and VI—VI in FIG. 2;

FIG. 10 represents a table of possible pyrotechnical mixtures;

DETAILED DESCRIPTION OF THE PREFERRED EMBODIMENTS

Figure 7:
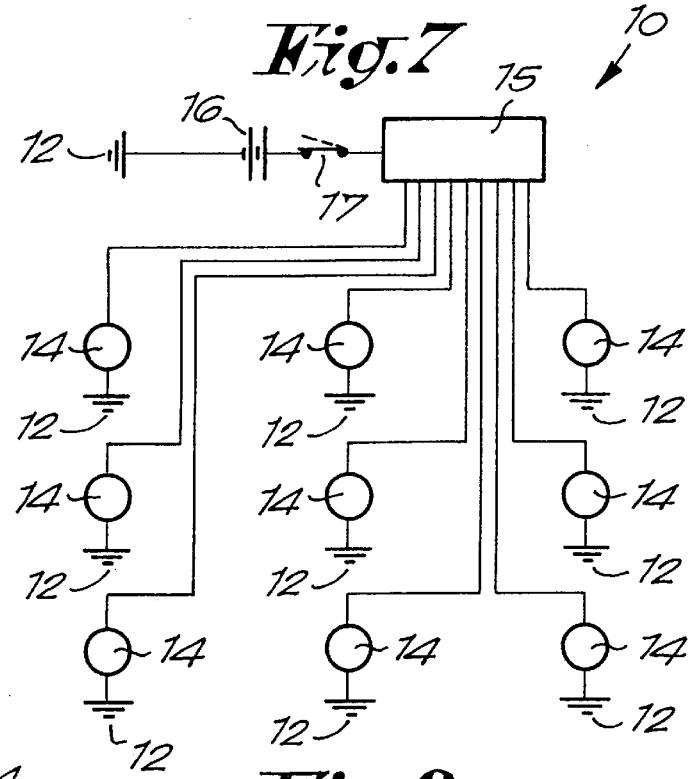
FIG. 7 shows a connection diagram of the ignition device according to the invention.

Although by a device is understood a portable briefcase or safety box in the examples described hereafter, it is clear that the present invention may also apply to fixed as well as moveable devices such as for example a safe or such.

A portable briefcase 1 is represented in FIGS. 1 to 6 which mainly consists of a base 2 and a lid 3 which is connected to the base 2 by means of appropriate hinges and locks 4–5 which are not represented here, and whose base is equipped with a handle 6.

This portable briefcase 1 can be made in any material whatsoever.

In general, the volume of the portable briefcase 1 is subdivided in three separate spaces, namely a first space 7 in which the securities 8, for example banknotes, can be safeguarded, a second space 9 in which the ignition and fire destruction mechanism 10 is mounted and a third space 11 in which one or several flues forming a labyrinth shaped path are provided through which the flames or gases which are released during the ignition or destruction by the fire, provoked by the ignition and fire destruction mechanism 10, are diminished before leaving the device.

The above-mentioned spaces 7 and 9 are separated from one another by means of a first partition comprising a metal plate 12, for example made of aluminium, in which a small hole 13 is provided on the spot where a wad of securities 8, for example banknotes, will be placed, whereby a capsule 14 is provided in the space 9 opposite each small hole 13, each filled with a pyrotechnical mixture.

All the capsules 14 are electrically connected to an electronic security system which, as represented in FIG. 7, can be built as follows:

Each capsule 14 is electrically connected to the ground consisting in this case of the first partition 12, and it is further connected to an electronic switching mechanism 15 which is placed in the electric circuit of a battery 16 situated between the switching mechanism 15 and the first partition, whereby a reversing switch 17 is provided in the above-mentioned electric circuit which makes it possible to put the security device under tension.

The third space 11 of the portable briefcase 1 is in this case confined by a second partition comprising a metal plate 18 forming a division between said third space 11 and the first space 7, whereby, relatively large holes 19 are provided in said second partition plate 18, opposite each wad of papers 8, in particular coaxially in relation to the holes 13 provided in the first partition 12.

Moreover, the third space 11 is subdivided in one or several flues, in this case one flue having a labyrinth shaped path 20 per capsule 14, whereby these flues 20 open into the atmosphere via a passage 21 provided to this end in the external wall of the third space 11 and in the adjacent walls of the base 2 and the lid 3.

Figure 8:
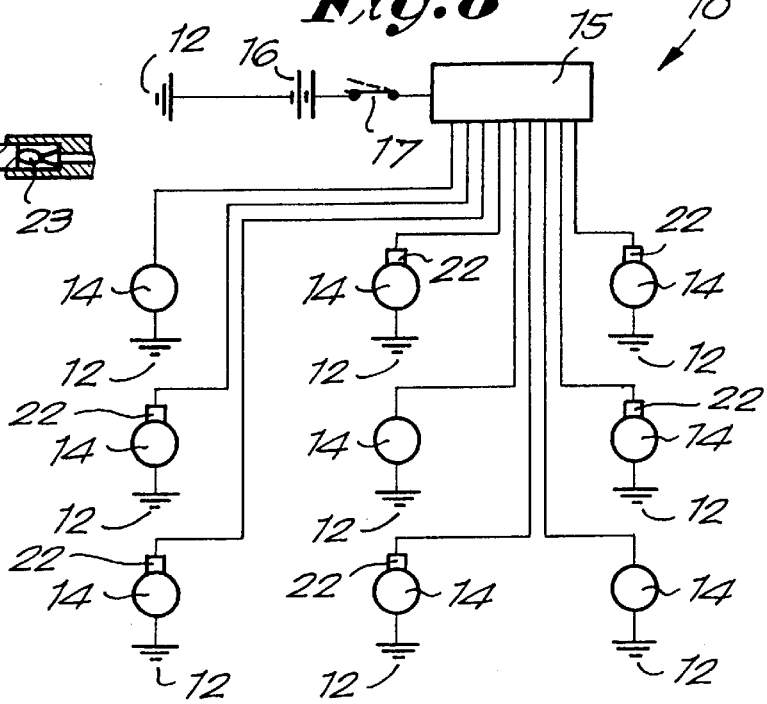
FIG. 8 shows a connection diagram of the same type as in FIG. 7, but for another embodiment.
Figure 11:
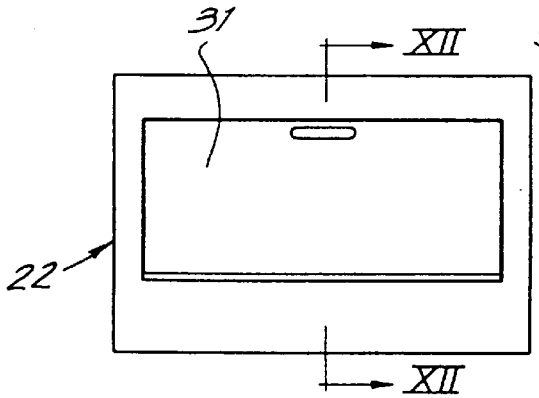
FIG. 11 shows a front view of a device according to the invention, but in relation to another embodiment, namely in the shape of a safety box.
Figure 14:
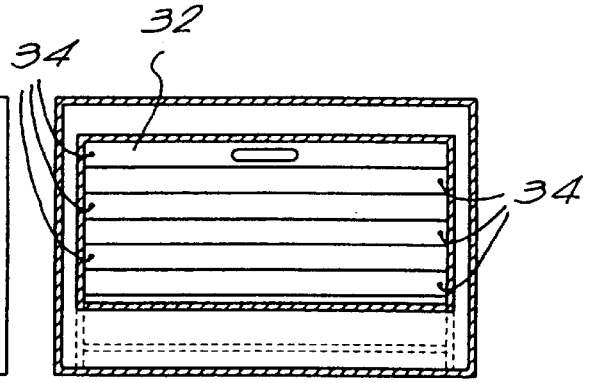
FIGS. 13 and 14 show sections according to lines XIII—XIII and XIV—XIV in FIG. 12.
Figure 12:
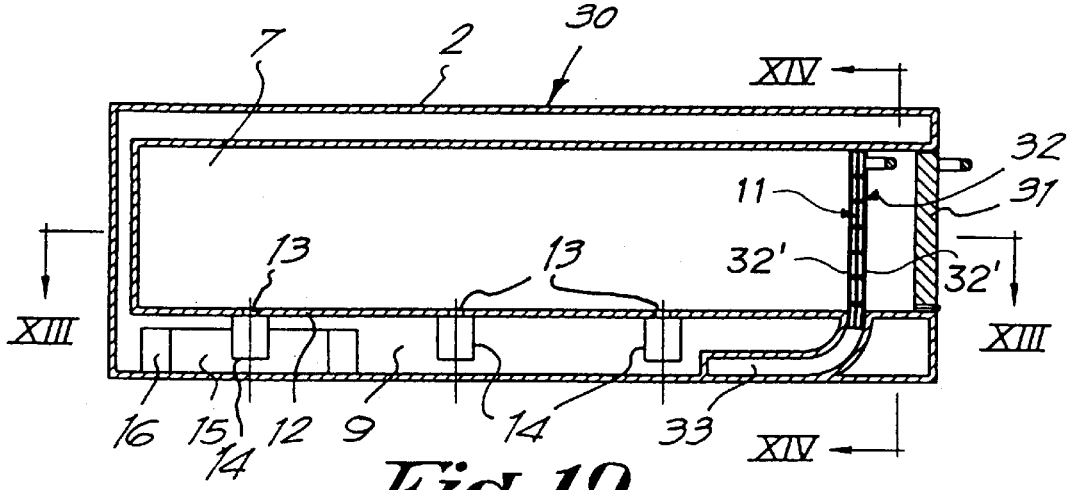
FIG. 12 shows a section according to lines XII—XII in FIG. 11.
Figure 13:
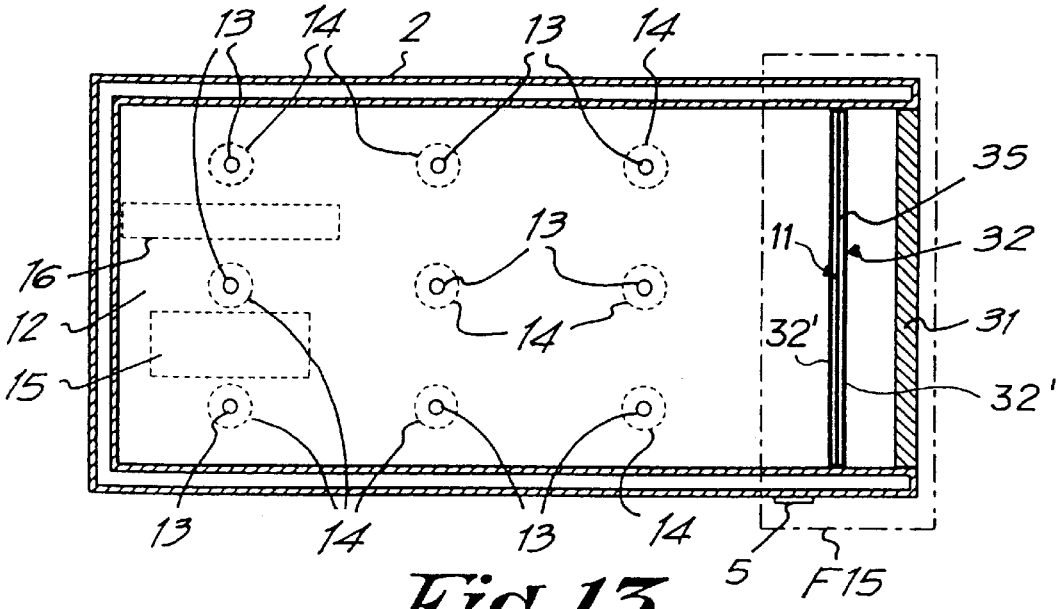
Figure 15:
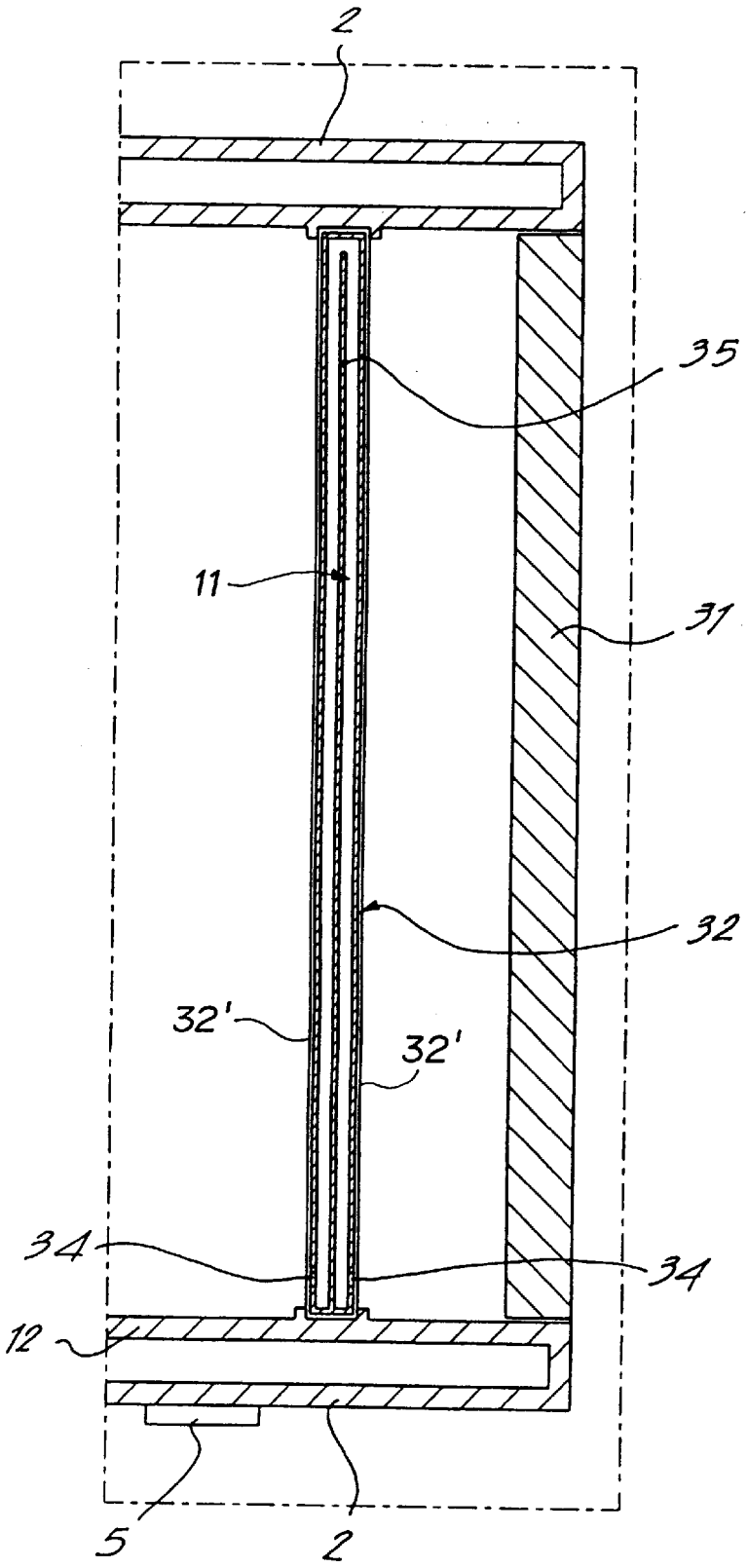
FIG. 15 shows the part indicated by F15 in FIG. 13 to a larger scale.

FIG. 8 shows a variant of the diagram according to FIG. 7, whereby, in this case, certain capsules 14 are equipped with what is called a retardation device 22 which forms a barrier between the ignition mechanism 23 and the pyrotechnical mixture of the capsule 14 so as to obtain a retarded ignition of the pyrotechnical mixture. These retardation devices may be identical to one another or they may be divided in groups or they may also be all different so as to obtain discharges going off at different moments.

Naturally, also other embodiments of the electronic security system are possible.

Figure 9:
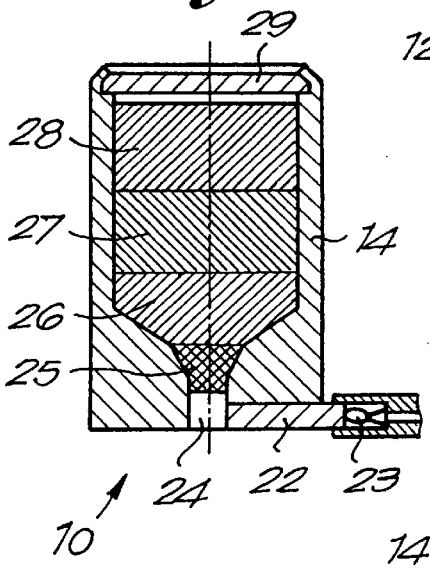
FIG. 9 shows a cross section of an ignition capsule as used in the device according to the invention.

Thus, FIG. 9 represents a capsule 14 made of steel, whereby this capsule 14 is coupled to the retarding mechanism 22 via an opening 24, to the ignition mechanism 23 respectively, and whereby a pyrotechnical mixture is put in said capsule 14 consisting of what are called pyrotechnical charges, in this case an ignition charge 25 and three fire destruction charges 26, 27 and 28 which may have an appropriate composition, the whole being sealed by a small plate 29 made of nonflammable material.

The pyrotechnical mixture may have any composition whatsoever; as an example only, a table of materials which can be used in any combination whatsoever, in compliance with the indicated proportions, in order to form an ignition charge 25, a fire destruction charge 26–27–28 respectively, is represented in FIG. 10.

The ignition charge may consist of magnesium, strontium peroxides and bonding materials, whereas the pyrotechnical mixture may consist of iron oxides, magnesium, aluminium, barium nitrate, graphite and synthetic phenol resin.

The use and working of the device according to the invention is very simple and as described below.

When a certain number of securities 8, for example bank notes, are put in a portable briefcase 1 according to the invention, for example in order to transport papers of this sort, these papers are placed exactly over the holes 13 provided in the first partition 12, in the first space 7 whose dimensions preferably correspond to those of the papers.

Then, the device 1 is closed such that the papers 8 are perfectly protected, whereby the reversing switch 17 is switched off in an appropriate manner as the briefcase is closed.

The reversing switch 17 can be provided at any place whatsoever, for example between the base 2 and the lid 3, in either of the locks 4–5, combined with a combination lock or combined with a keyboard for entering a code or via which one has to enter a code at regular intervals so as to switch off the reversing switch 17.

The reversing switch 17 or the electronic security system may also be remotely controlled, in which case the tripping of the security system does not need to coincide with the portable briefcase 1 being closed.

When someone wants to break into a portable briefcase 1 of this type, either by twisting the lid 3 or by distorting the locks 4 or 5, or also, in the case of a keyboard, by damaging this keyboard or by entering the wrong code, the reversing switch 17 will be switched on in the appropriate manner and, via the electronic switching mechanism 15, it will send a message to the capsules 14 ordering the ignition mechanism 23 to provoke the ignition of the ignition charge 25, and consequently of the fire destruction charges 26–27–28, such that, through the holes 13 provided in the first partition 12, a flame is lit transpiercing the wads of papers 8, whereby this flame and the produced gases are then led through a flue 20, where they are diminished before leaving the portable briefcase 1, such that flames and/or gases under pressure can by no means escape from the portable briefcase 1.

The thus realised piercing of the papers 8 may cause a conical, flattened burn hole in the wad of papers 8, having a diameter of about 3 to 4 cm in the base and of about 1 cm at the top, with a total height of at least 5 cm.

In this way, the papers 8 are made useless, but they remain as such, such that they can still be examined in one way or the other.

FIG. 8 shows another connection diagram in which is applied a retarding device 22 on certain capsules 14 so as to program the discharge of the capsules 14 such that, for example in the example represented in FIG. 8, three capsules 14 will flare up together, igniting a second series of three capsules 14 a few seconds later and finally igniting a third series of capsules 14 after another few seconds, such that the force of the ignition is spread in time.

FIGS. 11 to 15 represent another embodiment of the invention in which the device is made in the shape of a security box 30.

The construction is analogous to that of the portable briefcase 1, but the lid 3 is replaced by a door 31 in a narrow side wall of the security box 30, whereas the fourth space 11, in which are provided one or several flues having a labyrinth shaped path 20, is made in the shape of a movable shutter 32.

FIGS. 11 to 15 represent identical or analogous elements or spaces having the same reference numbers as used in FIGS. 1 to 6.

In this embodiment, the first partition 12 forms a tray, such that the second space 9 in which is mounted the ignition and fire destruction mechanism 10 extends all around the first space 7, with the exception of the front side where the door 31 is provided.

The door 31 can be bolted by means of a lock 5 with an electronic key.

The fourth space 11 which forms one or several flues 20 is not provided directly against the door 31, but it is provided against the inside at a certain distance of the latter in the movable shutter 32 which can glide over guides 33 in the second space 9.

The sections 32' of the movable shutter 32 are double-walled and are made of metal, and they each have an aperture 34 near one end. Each section 32' is divided in two in its longitudinal direction by means of a second partition 35 which is connected at one end to the far end of the section alongside which the aperture 34 are provided, whereby the other end remains at a short distance from the other far end of the section 32'.

Thus, a flue having a labyrinth shaped path 20 is formed in each section 32' through which the ignition gases coming in via the aperture 34 must cover a long distance before they come out of the aperture 34 against the outer side of the section 32' in the space provided between the movable shutter 32 and the door 31. From this space they can escape into the atmosphere through the clearance of the door 31.

Successive sections 32' of the movable shutter 32 are provided such that the apertures 34 are provided alternately on either side of the movable shutter 32.

By closing the door 31 or after it has been closed via a remote control, the reversing switch 17 is switched off or the security system is activated in one way or another.

In case of violation, the security box 31 works in the same manner as described above for the portable briefcase 30.

Thanks to the design of the movable shutter 32 described above, neither flames nor gases under pressure can escape from this security box 30.

It is clear that the present invention is in noway limited to the embodiments described as example and shown in the annexed drawings; a device according to the invention may be realised in all sorts of shapes and dimensions without falling outside the scope of the invention.

What is claimed is:

1. A device for protecting valuable papers such as securities, comprising:

a closeable unit which is divided by a first partition having a plurality of apertures into at least a first space and a second space, the first space being arranged to hold papers to be protected which may be placed on one side of said first partition opposite the first partition apertures;

pyrotechnics provided in the second space located at a side of the first partition opposite said one side and the pyrotechnics comprising capsules placed in a network opposite each of said first partition apertures opposite said one side of said first partition and each containing a pyrotechnical mixture which, when the device is manipulated in an unwanted manner, will inflame so as to produce a flame which propagates through said first partition aperture transpiercing any papers in the first space opposite said aperture thereby making the papers worthless but recognizable;

a tray formed by the first partition, said closeable unit having a portion defining an opening at one end of said tray; and a door mounted near the opening so as to close the closeable unit.

2. The device according to claim 1, further comprising:

a third space located towards the side of said first space located near said door; and a shutter moveable between open and closed positions and which, when closed, separates the third space from the first space, said movable shutter being mounted to the tray at a short distance from the door and arranged to seal the first space when it is in its closed position.

3. The device according to claim 2 wherein the movable shutter has a plurality of double-walled sections forming a fourth space, each double-walled section having at least one aperture on each wall at a first end of said movable shutter such that a first wall external to the first space has a first aperture and a second wall external to the third space has a second aperture, and a second partition connected to the first end of the movable shutter between said first and second walls dimensioned and configured so as to form a labyrinth shaped flue between said first and second walls that is in communication with said first aperture and said second aperture.

4. The device according to claim 1, wherein each of the capsules comprises:

a metal envelope filled with the pyrotechnical mixture and having one end located adjacent said first partition;

a small plate closing off said one end of the metal envelope, the small plate being made of nonflammable material; and an ignition mechanism coupled to an end of the metal envelope remote from the first partition.

5. The device according to claim 4, wherein at least one of the capsules further comprises a retarding device provided between the ignition mechanism and the pyrotechnical mixture.

6. The device according to claim 1, wherein the pyrotechnical mixture comprises:

an ignition charge; and at least one fire destruction charge.

7. The device according to claim 4, further comprising an electronic security system electrically connected to each of the capsules.

8. The device according to claim 7, wherein the security system includes a reversing switch which is activated by a mobile part of the device.

* * * * *